US011462810B2

(12) United States Patent
Kamgaing et al.

(10) Patent No.: US 11,462,810 B2
(45) Date of Patent: Oct. 4, 2022

(54) MULTIPLEXER AND COMBINER STRUCTURES EMBEDDED IN A MMWAVE CONNECTOR INTERFACE

(71) Applicant: Intel Corporation, Santa Clara, CA (US)

(72) Inventors: Telesphor Kamgaing, Chandler, AZ (US); Sasha Oster, Chandler, AZ (US); Georgios Dogiamis, Chandler, AZ (US); Johanna Swan, Scottsdale, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 17/194,022

(22) Filed: Mar. 5, 2021

(65) Prior Publication Data

US 2021/0194106 A1 Jun. 24, 2021

Related U.S. Application Data

(63) Continuation of application No. 16/466,629, filed as application No. PCT/US2017/012364 on Jan. 5, 2017, now Pat. No. 10,992,016.

(51) Int. Cl.

| | |
|---|---|
| ***H01P 5/08*** | (2006.01) |
| ***H01P 1/207*** | (2006.01) |
| ***H01P 3/12*** | (2006.01) |

(52) U.S. Cl.
CPC ..... *H01P 5/08* (2013.01); *H01P 1/207* (2013.01); *H01P 3/12* (2013.01)

(58) Field of Classification Search
CPC ..... H01P 5/08; H01P 1/207; H01P 3/12
See application file for complete search history.

(56) References Cited

U.S. PATENT DOCUMENTS 6,657,520 B2 * 12/2003 Mack ..... H01P 1/207 333/208
2003/0006866 A1 1/2003 Yoneda et al.
(Continued)

FOREIGN PATENT DOCUMENTS

| | | |
|---|---|---|
| CN | 101138154 | 3/2008 |
| CN | 101694903 | 4/2010 |

(Continued)

OTHER PUBLICATIONS

International Preliminary Report on Patentability for International Patent Application No. PCT/US2017/012364, dated Jul. 18, 2019, 12 pages.

(Continued)

*Primary Examiner* — Stephen E. Jones
*Assistant Examiner* — Kimberly E Glenn
(74) *Attorney, Agent, or Firm* — Schwabe, Williamson & Wyatt, P.C.

(57) ABSTRACT

Embodiments of the invention include a mm-wave waveguide connector and methods of forming such devices. In an embodiment the mm-wave waveguide connector may include a plurality of mm-wave launcher portions, and a plurality of ridge based mm-wave filter portions each communicatively coupled to one of the mm-wave launcher portions. In an embodiment, the ridge based mm-wave filter portions each include a plurality of protrusions that define one or more resonant cavities. Additional embodiments may include a multiplexer portion communicatively coupled to the plurality of ridge based mm-wave filter portions and communicative coupled to a mm-wave waveguide bundle. In an embodiment the plurality of protrusions define resonant cavities with openings between 0.5 mm and 2.0 mm, the plurality of protrusions are spaced apart from each other by a spacing between 0.5 mm and 2.0 mm, and wherein the plurality of protrusions have a thickness between 200 μm and 1,000 μm.

21 Claims, 8 Drawing Sheets

(56) References Cited

U.S. PATENT DOCUMENTS

| | | | | |
|---|---|---|---|---|
| 2003/0185484 | A1 | 10/2003 | Chakravorty et al. | |
| 2003/0206082 | A1 | 11/2003 | Chen | |
| 2006/0186969 | A1 | 8/2006 | Rauscher | |
| 2012/0051700 | A1 | 3/2012 | Terada et al. | |
| 2021/0407934 | A1* | 12/2021 | Prabhu Gaunkar ..... | H01L 23/66 |

FOREIGN PATENT DOCUMENTS

| | | | | | |
|---|---|---|---|---|---|
| CN | 105009355 | | | 10/2015 | |
| CN | 107895830 | A | * | 4/2018 | ..... H01P 1/207 |
| EP | 2988365 | | | 2/2016 | |
| TW | 200306653 | | | 11/2003 | |

OTHER PUBLICATIONS

International Search Report and Written Opinion for International Patent Application No. PCT/US2017/012364 dated Sep. 28, 2017, 13 pgs.

Office Action from Chinese Patent Application No. 201780075460.2, dated Mar. 3, 2021, 8 pgs.

2nd Office Action from Chinese Patent Application No. 201780075460.2, dated Jul. 19, 2021, 14 pgs.

Office Action from Chinese Patent Application No. 201780075460.2, dated Mar. 3, 2022, 5 pgs.

Notice of Allowance from Chinese Patent Application No. 201780075460.2, dated May 25, 2022, 4 pgs.

* cited by examiner

MULTIPLEXER AND COMBINER STRUCTURES EMBEDDED IN A MMWAVE CONNECTOR INTERFACE

CROSS-REFERENCE TO RELATED APPLICATION

This patent application is a Continuation of U.S. patent application Ser. No. 16/466,629, filed Jun. 4, 2019, which is a U.S. National Phase Application under 35 U.S.C. § 371 of International Application No. PCT/US2017/012364, filed Jan. 5, 2017, entitled "MULTIPLEXER AND COMBINER STRUCTURES EMBEDDED IN A MMWAVE CONNECTOR INTERFACE," which designates the United States of America, the entire disclosure of which is hereby incorporated by reference in its entirety and for all purposes.

FIELD OF THE INVENTION

Embodiments of the invention are in the field of interconnect technologies and, in particular, formation of a mm-wave connector that includes a multiplexer and filters.

BACKGROUND OF THE INVENTION

As more devices become interconnected and users consume more data, the demand on improving the performance of servers has grown at an incredible rate. One particular area where server performance may be increased is the performance of interconnects between components, because there are many interconnects within server and high performance computing (HPC) architectures today. These interconnects include within blade interconnects, within rack interconnects, and rack-to-rack or rack-to-switch interconnects. In order to provide the desired performance, these interconnects may need to have increased data rates and switching architectures which require longer interconnects. Furthermore, due to the large number of interconnects, the cost of the interconnects and the power consumption of the interconnects should both be minimized. In current server architectures, short interconnects (e.g., within rack interconnects and some rack-to-rack) are achieved with electrical cables, such as Ethernet cables, co-axial cables, or twin-axial cables, depending on the required data rate. For longer distances (e.g., greater than five meters), optical solutions are employed due to the long reach and high bandwidth enabled by fiber optic solutions.

However, as new architectures emerge, such as 100 Gigabit Ethernet, traditional electrical connections are becoming increasingly expensive and power hungry to support the required data rates for short (e.g., 2 meters to 5 meters) interconnects. For example, to extend the length of a cable or the given bandwidth on a cable, higher quality cables may need to be used or advanced equalization, modulation, and/or error correction techniques employed. Accordingly, these solutions require additional power and increase the latency to the system. Optical transmission over fiber is capable of supporting the required data rates and distances, but at a severe power and cost penalty, especially for short to medium distances (e.g., a few meters) due to the need for optical interconnects.

For some distances and data rates required in proposed architectures, there is no viable electrical solution today. For medium distance communication in a server farm, the overhead power associated with the optical fiber interconnects is too high, whereas the required error correction on traditional electrical cables creates a substantial latency (e.g., several hundred nanoseconds). This makes both technologies (traditional electrical and optical) not particularly optimal for emerging rack-scale architecture (RSA) servers including HPCs, where many transmission lines are between 2 and 5 meters.

One proposed interconnect technology that may provide high data rates with lower power consumption is mm-wave waveguides, mm-wave waveguides propagate mm-wave signals along a dielectric waveguide. Dielectric waveguides are beneficial because there is no need for forward error correction and power is conserved since there is no power intensive electrical to optical conversion. However, the propagation of mm-waves along a dielectric cable may be dispersion limited and depends on the specific waveguide architecture. The dielectric waveguide may be loss-limited if the incurred dispersion over the length of the channel is not significant (typically in pure dielectric waveguides), or may be dispersion limited if the incurred dispersion over the length of the channel is significant (typically in metal air core waveguides). Dispersion describes the phenomenon that not all frequencies have the same velocity as they are propagated through the dielectric material. Accordingly, in longer mm-wave waveguides the signal may incur excessive dispersion and spread too much therefore becoming difficult to decode at the receiving end.

DETAILED DESCRIPTION OF THE INVENTION

Described herein are systems that include mm-wave guide connectors that include a multiplexer and a ridge based waveguide filter. In the following description, various aspects of the illustrative implementations will be described using terms commonly employed by those skilled in the art to convey the substance of their work to others skilled in the a. However, it will be apparent to those skilled in the art that the present invention may be practiced with only some of the described aspects. For purposes of explanation, specific numbers, materials and configurations are set forth in order to provide a thorough understanding of the illustrative implementations. However, it will be apparent to one skilled in the art that the present invention may be practiced without the specific details. In other instances, well-known features are omitted or simplified in order not to obscure the illustrative implementations.

Various operations will be described as multiple discrete operations, in turn, in a manner that is most helpful in understanding the present invention, however, the order of description should not be construed to imply that these operations are necessarily order dependent. In particular, these operations need not be performed in the order of presentation.

As noted above, mm-wave waveguides may be dispersion limited, and not all frequencies are propagated at the same velocity. This results in the signal spreading as it is propagated along the mm-wave waveguide. Particularly, the difference in the velocity between frequencies increases the further apart the frequencies are away from each other. Accordingly, a signal with a relatively large bandwidth will be limited by dispersion to a greater extent than a relatively small bandwidth.

Figure 1:
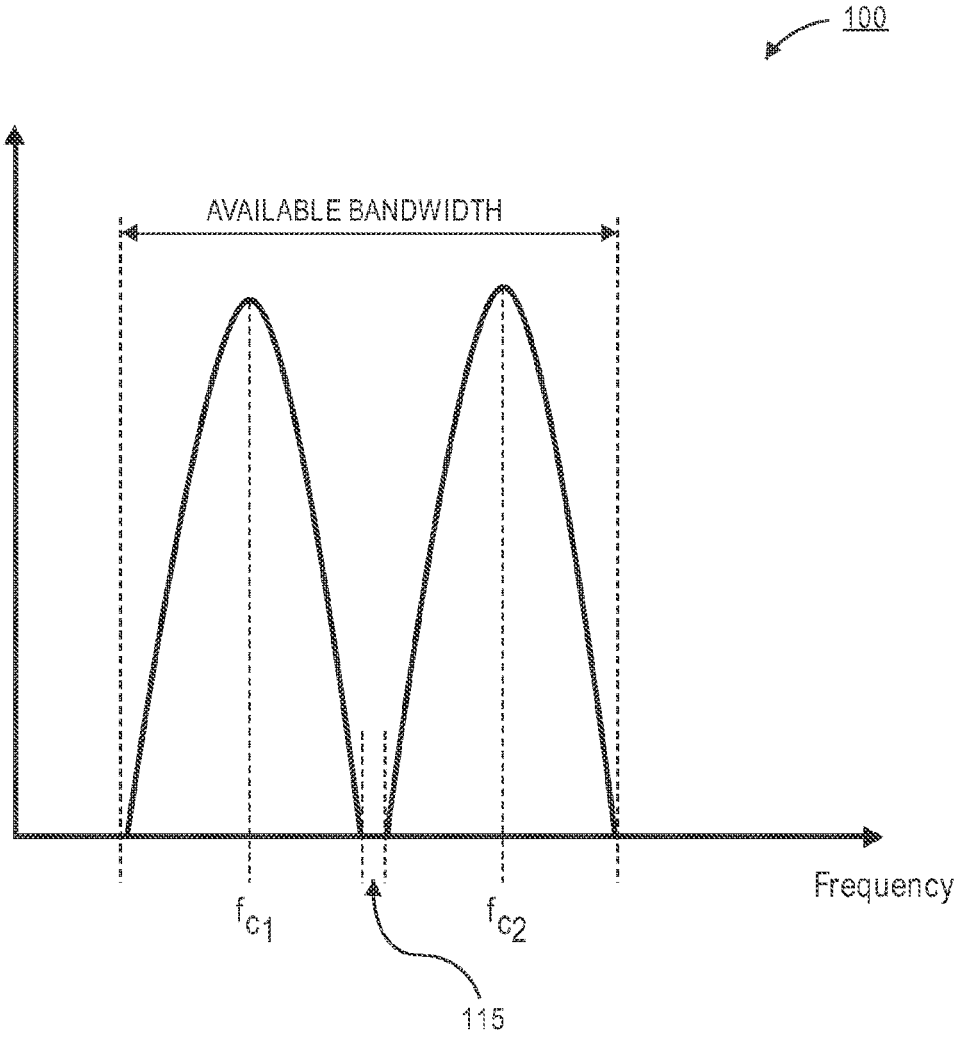
FIG. 1 is an illustration of a plot of the available bandwidth of a system that has been channelized in order to reduce the effects of dispersion by using multiple carrier frequencies that are separated by a guard band, according to an embodiment of the invention.

Accordingly, embodiments of the invention include a mm-wave waveguide connector that includes a multiplexer that allows for a total available bandwidth to be broken into two or more bands. FIG. 1 is an illustration of a plot 100 of the available bandwidth of a system that has been channelized in order to reduce the effects of dispersion by using two carrier frequencies $fc_1$ and $fc_2$. Since each band has a smaller bandwidth than the total available bandwidth, the total dispersion of each band is reduced. However, in order to minimize cross-talk between bands, it may be necessary to include a guard band 115 between the two carrier frequencies. The guard band 115 reduces interference between bands, but it also results in wasting portions of the available bandwidth since signals cannot be transmitted over the frequencies in the guard band. With currently available bandpass filters that are integrated on the package or on the chip (e.g., RF filters, such as lumped element filters, etc.) it is very challenging to design for a very steep roll-off in order to achieve very narrow guard bands. Accordingly, the guard band needs to be approximately 5 GHz or more to minimize interference. This reduces a significant amount of bandwidth (especially when more than two bands are used). While two carrier frequencies are illustrated in FIG. 1, it is to be appreciated that any number of bands may be used according to embodiments of the invention. For example, as the number of bands increases, the dispersion of each band may be reduced.

Therefore, embodiments of the invention may also include mm-wave waveguide connectors that also include one or more bandpass filters. Particularly, embodiments of the invention may include ridge based waveguide filters. A ridge based waveguide filter may allow for improved roll-off and allow for a narrower guard band. For example, embodiments of the invention may include ridge based waveguide filters that allow for the signal to be reduced by approximately 20 dB within approximately 2 GHz. Accordingly, the guard band may be reduced to between 1 GHz and 2 GHz while still providing acceptable interference reduction. Compared to the bandpass filters currently used, this may allow for a significant improvement in overall data rate. For example, a 1 GHz guard band will provide an additional 4 GHz of bandwidth (per each guard band needed), which may provide a data rate increase of 8 Gbps when quadrature amplitude modulation 16 (QAM16) is used.

Furthermore, since the bandpass filter is integrated with the mm-wave waveguide connector, no bandpass filters are needed on the transceiver die. This reduces the complexity of the design of the package and/or die, and also preserves a significant amount of area on the package or die. Additionally, removing the bandpass filter from the die decouples the bands from the design of the die. For example the die may be designed to operate at a single wide band, and the mm-wave waveguide connector may include the filtering to choose the desired channelized bands that are transmitted over the mm-wave waveguide. Accordingly, if changes are desired, a new connector is all that is needed instead of replacing the die.

While the bandpass filters are included in the mm-wave waveguide connector, it is to be appreciated that the inclusion of the filters may not drastically increase the size of the connector. Due to the relatively high frequencies that are being filtered (e.g., above 100 GHz), embodiments may include ridge based waveguide filters that have a small form factor (e.g., less than approximately 9 mm or less in length).

Figure 2:
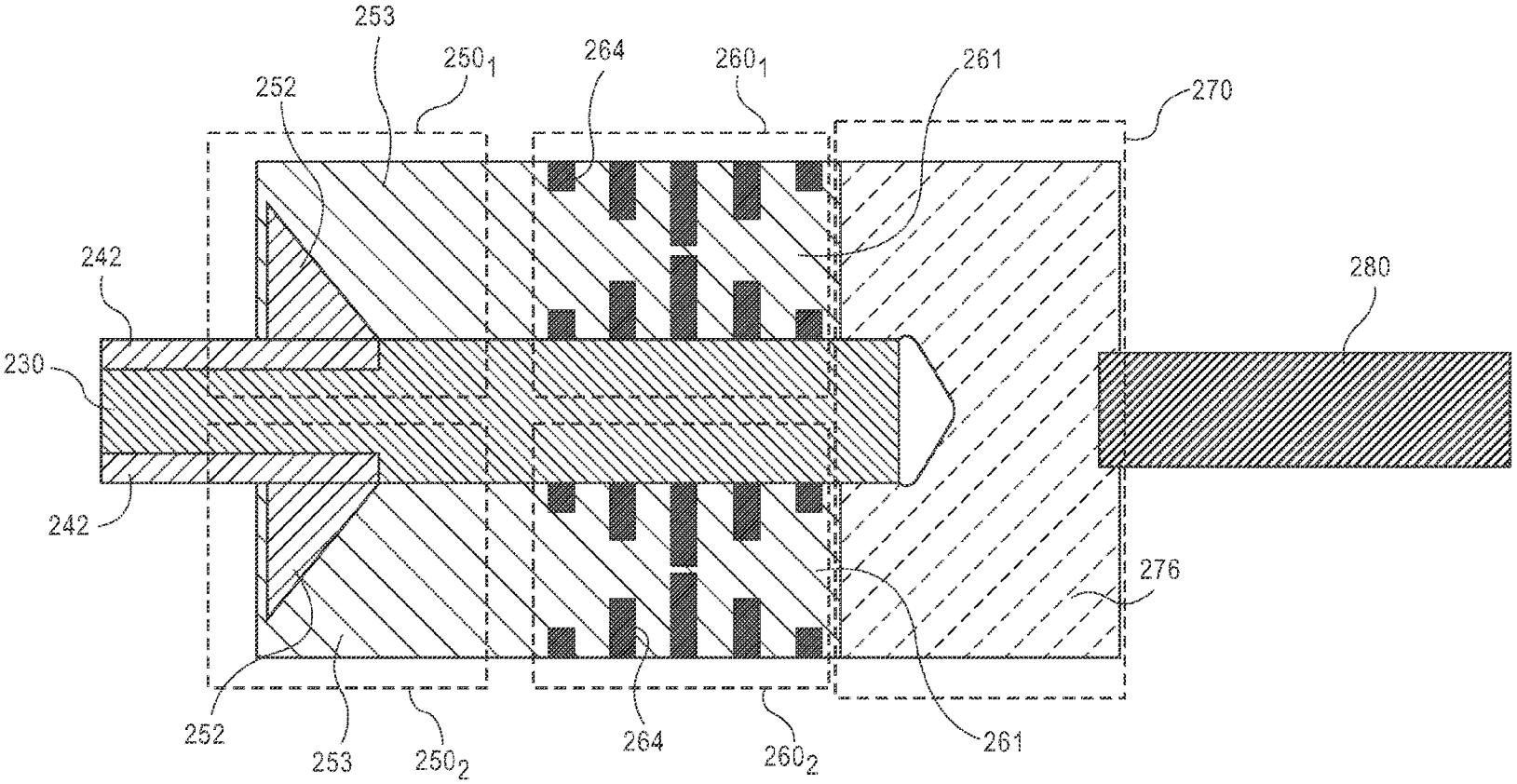
FIG. 2 is a cross-sectional illustration of a mm-wave waveguide connector that includes a multiplexer and a ridge based waveguide filter, according to an embodiment of the invention.

Referring now to FIG. 2, a cross-sectional illustration of a mm-wave waveguide connector 220 is shown, according to an embodiment of the invention. In an embodiment, the mm-wave waveguide connector 220 may include a mm-wave launcher portion 250, a filter portion 260, and a multiplexer portion 270. Depending on the number of bands that are desired, the mm-wave waveguide connector 220 may include two or more mm-wave launcher portions 250, two or more filter portions 260, and the multiplexer portion 270 may include any number of splitters/combiners to combine or separate the bands when the signal enters or exits a mm-wave waveguide 280. For example, the illustrated embodiment includes a first and second mm-wave launcher portions $\mathbf{250}_1$ and $\mathbf{250}_2$, a first and second filter portion $\mathbf{260}_1$ and $\mathbf{260}_2$, and a multiplexer portion 270 for routing the two separate bands to or from the mm-wave waveguide 280.

In an embodiment, the mm-wave connector 220 may be an edge connector that communicatively and mechanically couples the mm-wave waveguide 280 to a package substrate 230 (e.g., a package substrate in a server or other higher performance computing (HPC) device). For example, the first mm-wave launcher portion $\mathbf{250}_1$ and the first filter portion $\mathbf{260}_1$ of the mm-wave waveguide connector 220 may be positioned on a top surface of the package 230, and the second mm-wave launcher portion $\mathbf{250}_2$ and the second filter portion $\mathbf{260}_2$ of the mm-wave waveguide connector 220 may be positioned on a bottom surface of the package 230. However, additional embodiments of the invention may include any other configuration of the individual components of the mm-wave waveguide connector 220, and is not limited to the illustrated embodiment.

In an embodiment, the mm-wave waveguide connector 220 may be formed as a single component, or one or more of the mm-waveguide launcher portions 250, the filter portions 260, and the multiplexer portion 270 of the mm-wave waveguide connector 220 may be formed as discrete components that are attached together (e.g., with a male-female connection). In one embodiment, a one-piece connector 220 (e.g., a one piece edge connector) may be slid onto the edge of a package 230. In such embodiments, the package 230 may have mechanical stops and alignment features. In an alternative embodiment, a one-piece connector 220 may also be fabricated directly onto the package 230. In embodiments that include a mm-wave waveguide connector 220 that is formed with discrete components that attach together, embodiments may include a one or more of the components being fabricated on the package and connected to the remaining components that are fabricated by themselves. For example, the mm-wave launcher 250 may be assembled directly on the package 230 and serve as the male connector that connects to a filter portion 260. The filter portion 260 may also be integrated with the multiplexer portion 270 or they may be discrete components connected together.

In an embodiment, the mm-wave launcher portion 250 may include a mm-wave launcher 252. The mm-wave launcher 252 may be any suitable mm-launcher 252 for initiating the propagation of mm-waves or receiving mm-waves, such as a regular patch launcher, a stacked-patch launcher, a microstrip-to-slot transition launcher, a leaky-travelling-wave based launcher, or the like. In an embodiment, the mm-wave launcher 252 may be electrically coupled to a microstrip line 242 formed on or within the package substrate 230. In an embodiment, the mm-wave launcher 252 may be embedded within a dielectric material 253. While not shown, the mm-wave launcher portion 250 may include a conductive coating surrounding the dielectric material 253. In some embodiments, the dielectric material may be omitted and the mm-wave launcher portion 250 may include air surrounded by a conductive body.

In an embodiment, the mm-wave launcher portion 250 is communicatively coupled to a filter portion 260. In an embodiment, the filter portion 260 may include a ridge based waveguide filter. A ridge based waveguide filter may include a plurality of protrusions 264 of various sizes that form a plurality of resonant cavities within the filter portion 260. For example, the ridge based waveguide filter may be a first order filter, a second order filter, a third order filter, etc. In an embodiment, the protrusions 264 of the ridge based waveguide filter may be embedded within a dielectric material 261. While not shown, the filter portion 260 may include a conductive coating surrounding the dielectric material 261. In an embodiment, the dielectric material 261 is the same dielectric material 253 used in the mm-wave launcher portion 250, though embodiments may also include using different dielectric materials for each portion. In some embodiments, the dielectric material 261 may be omitted and the filter portion 260 may include air surrounded by a conductive body. A more detailed explanation of the ridge based waveguide filter is described below with respect to FIGS. 3A-3C.

In an embodiment, the multiplexer portion 270 is communicatively coupled to the filter portion 260. Depending on the number of bands that are used, embodiments may include a multiplexer portion 270 that includes any number of combiners/splitters. For example, in FIG. 2, the multiplexer portion 270 includes a combiner/splitter that allows for two bands to be propagated along the mm-wave waveguide 280. In an embodiment, the multiplexer portion 270 is formed with a dielectric material 276. In an embodiment, the dielectric material 276 may be the same material as the dielectric material 261 used in the filter portion 260, though embodiments may also include using different dielectric materials for each portion. While not shown, the multiplexer portion 270 may include a conductive layer surrounding the dielectric material 276. In some embodiments, the dielectric material 276 may be omitted and the multiplexer portion 270 may include air surrounded by a conductive body. A more detailed explanation of the multiplexer portion 270 is described in greater detail below with respect to FIGS. 4A and 4B.

In an embodiment, a single mm-wave waveguide 280 is coupled to the multiplexer portion 270, though embodiments are not limited to such configurations. For example, two or more mm-wave waveguide 280 may be coupled to the multiplexer portion 270 (e.g., to form a waveguide bundle). In an embodiment, the mm-wave waveguide 280 may be any suitable dielectric material, such as liquid crystal polymer (LCP), low-temperature co-fired ceramic (LTCC), glass, polytetrafluoroethylene (PTFE), expanded PTFE, low-density PTFE, ethylene tetrafluoroethylene (ETFE), fluorinated ethylene propylene (FEP), polyether ether ketone (PEEK), or perfluoroalkoxy alkanes (PFA), combinations thereof, or the like. In an embodiment, the mm-wave waveguide 280 may also include a conductive layer (not shown) over the dielectric layer to provide electrical shielding.

Figure 3A:
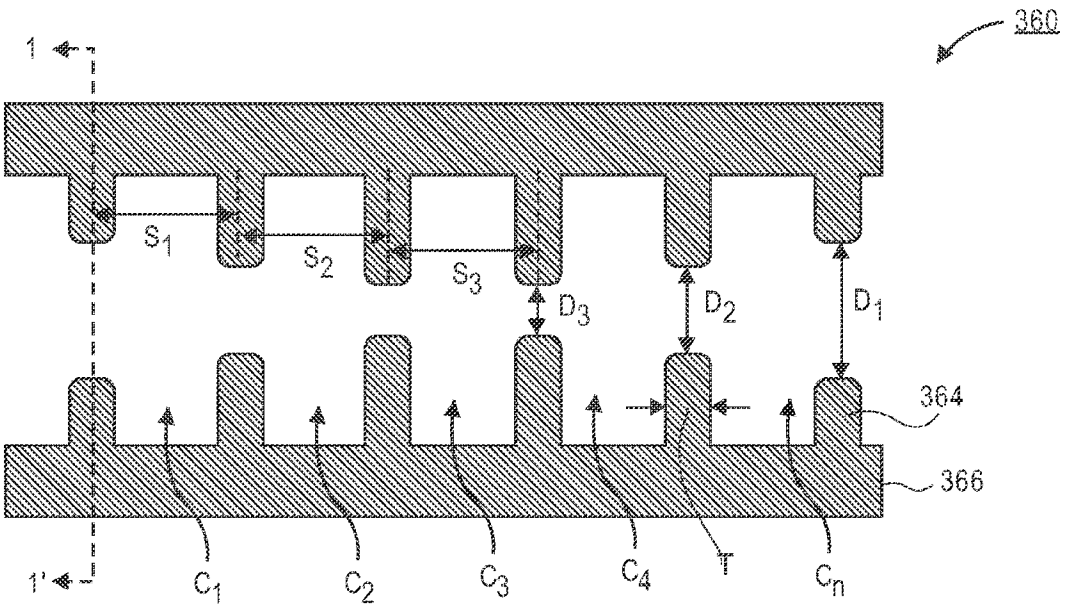
FIG. 3A is a cross-sectional illustration of the ridge based waveguide filter, according to an embodiment of the invention.

Referring now to FIG. 3A, a cross-sectional illustration of an exemplary filter portion 360 that includes a ridge based waveguide filter is shown, according to an embodiment of the invention. In an embodiment, the filter portion 360 may include a conductive enclosure 366 formed around a dielectric material (not shown for clarity). However, it is to be appreciated that the dielectric material may be omitted and an air filled filter may be used as well. In an embodiment, a plurality of protrusions 364 may extend from the conductive enclosure 366. The plurality of protrusions 364 may define a plurality of resonant cavities $C_1$-$C_n$. The "order" of the filter refers to the number of cavities in the filter. For example, in the illustrated embodiment, the filter is a fifth order filter since there are five resonant cavities.

Increasing the order of the filter allows for a steeper roll-off. For example, a fifth order filter may allow for up to a 20 dB reduction within 2 GHz. As such, the interference between frequency bands may be reduced. Moreover, since the roll-off happens within 2 GHz, the guard bands needed between frequency bands may be between approximately 1 GHz to 3 GHz. Compared to current solutions described above with 5 GHz guard bands, the steep roll-off produced by ridge based waveguide filters also lead to maximization of the usable bandwidth for transmitting signals. For example, when three bands are used with two 1 GHz guard bands, 8 GHz of bandwidth may be recovered compared to when a 5 GHz guard band is needed. Accordingly, the transmission of signals using such an embodiment results in an increased data rate of approximately 16 Gbps when QAM16 is used.

In an embodiment, openings D between opposing protrusions 364 allow for the mm-wave to propagate through the ridge based waveguide filter. The size of each opening D may be different for each set of opposing protrusions 364. For example, $D_1$ is larger than $D_2$, which is larger than $D_3$. In an embodiment, two or more of the openings D may be the same. For example, the three leftmost opposing pairs of protrusions 364 may be a mirror image or the three rightmost opposing pairs of protrusions 364. In an embodiment all of the openings D may have different measurements. According to an embodiment where the frequency being propagated is between approximately 90 GHz and 140 GHz, the openings D may be between approximately 0.5 mm and 2.0 mm.

In an embodiment, the spacing S between the centerlines of neighboring protrusions 364 may be substantially uniform. For example, $S_1$-$S_3$ may be substantially the same. In alternative embodiments, the spacing S between the centerlines of neighboring protrusions 364 may be non-uniform. According to an embodiment where the frequency being propagated is between approximately 90 GHz and 140 GHz, the spacing S between neighboring protrusions 364 may be between approximately 0.5 mm and 2.0 mm. In an embodiment, the thickness T of each protrusion 364 may be substantially uniform. In alternative embodiments, the thickness T of each protrusion 364 may be non-uniform. According to an embodiment where the frequency being propagated is between approximately 90 GHz and 140 GHz, the thickness T of each of the protrusions 364 may be between approximately 200 μm and 1,000 μm.

Figure 3C:
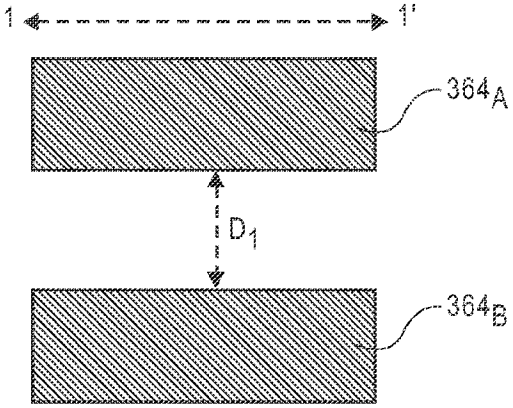
FIG. 3C is a cross-sectional illustration of a protrusion in the ridge based waveguide filter that forms a continuous gap across the filter, according to an embodiment of the invention.
Figure 3B:
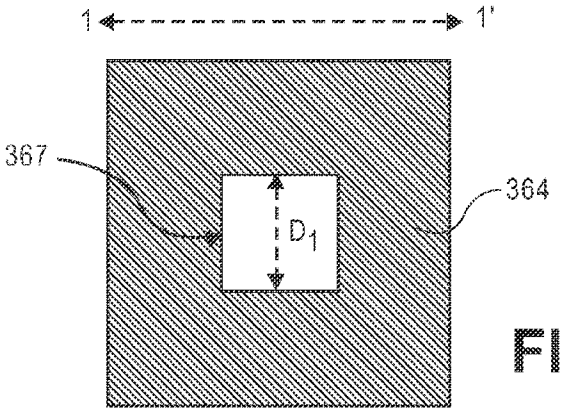
FIG. 3B is a cross-sectional illustration of a protrusion that forms an aperture in the ridge based waveguide filter, according to an embodiment of the invention.

Referring now to FIG. 3B, a cross-sectional illustration of the protrusions 364 along line 1-1' in FIG. 3A is shown, according to an embodiment of the invention. In the illustrated embodiment, the opposing protrusions shown in FIG. 3A may be connected to each other out of plane of the figure. For example, in FIG. 3B the protrusions 364 are shown wrapping around the perimeter of the filter to form an aperture 367. In an embodiment, the aperture 367 may be substantially square (i.e., the width is substantially equal to the distance $D_1$. In additional embodiments, the aperture 367 may not be substantially square. For example, the aperture 367 may have a width that greater than or less than the distance $D_1$ (i.e., the aperture 367 may be substantially rectangular).

Referring now to FIG. 3C, a cross-sectional illustration of the protrusions 364 along line 1-1' in FIG. 3A is shown, according to an embodiment of the invention. In the illustrated embodiment, the opposing protrusions shown in FIG. 3A may not be connected to each other out of plane of the figure. As such, the opposing protrusions $\mathbf{364}_A$ and $\mathbf{364}_B$ may be formed with structures that are not in direct contact with each other.

Figure 4A:
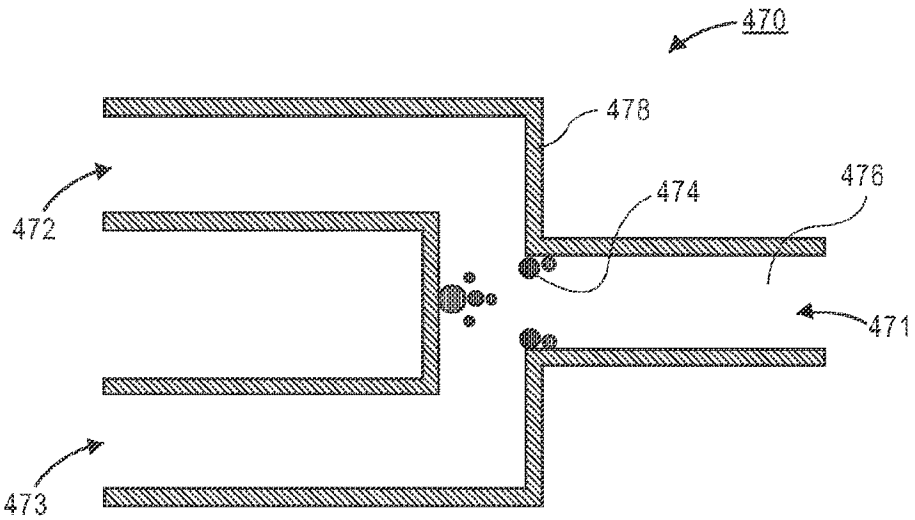
FIG. 4A is a cross-sectional illustration of a diplexer that may be used in a mm-wave waveguide connector, according to an embodiment of the invention.
Figure 4B:
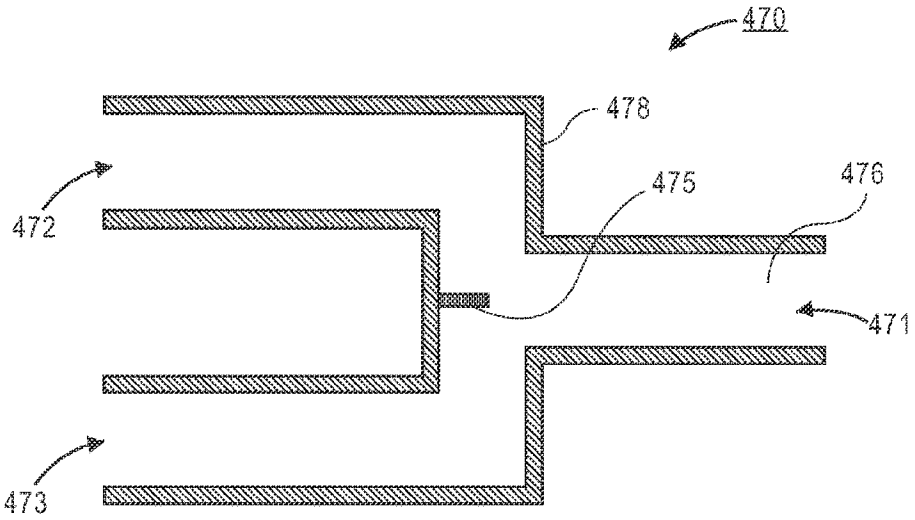
FIG. 4B is a cross-sectional illustration of a diplexer that may be used in a mm-wave waveguide connector, according to an embodiment of the invention.

Referring now to FIGS. 4A and 4B, cross-sectional illustrations of a multiplexer portion 470 of the mm-wave waveguide connector are shown in greater detail, according to embodiments of the invention. In the illustrated embodiments, the multiplexer portion 470 includes a conductive layer 478 that defines the waveguide pathway, including a splitter/combiner. While the dielectric material 476 is not shown for clarity, it is to be appreciated that a dielectric material 476 may be formed between the conductive layers 478 in some embodiments. In the illustrated embodiments, the multiplexer portions 470 are shown as a splitter/combiner that allows for a two signals 472, 473 to be combined to form a single output 471. It is to be appreciated that the splitter/combiner may also work in reverse to split a single incoming signal 471 into two component signals 472 and 473. Furthermore, while a two to one (2:1) input/output ratio is shown, embodiments of the invention may include any input/output ratio. For example, in embodiments where three bands are used to propagate a signal along a waveguide, the input/output ratio will be 3:1.

FIGS. 4A and 4B show a substantially similar structure with the exception of additional components that may be used to aid in splitting/combining the signal. For example, in FIG. 4A a plurality of circular pillars may be arranged within the body of the splitter/combiner in order to enhance the ability to split and/or combine a signal. An alternative example is shown in FIG. 4B where a fin 475 is formed at the split. While two different components for enhancing the splitting/combining of signals are shown in FIGS. 4A and 4B, it is to be appreciated that any other modification may be made to the multiplexer portion 470 to enhance the ability to split and/or combine signals.

Figure 5A:
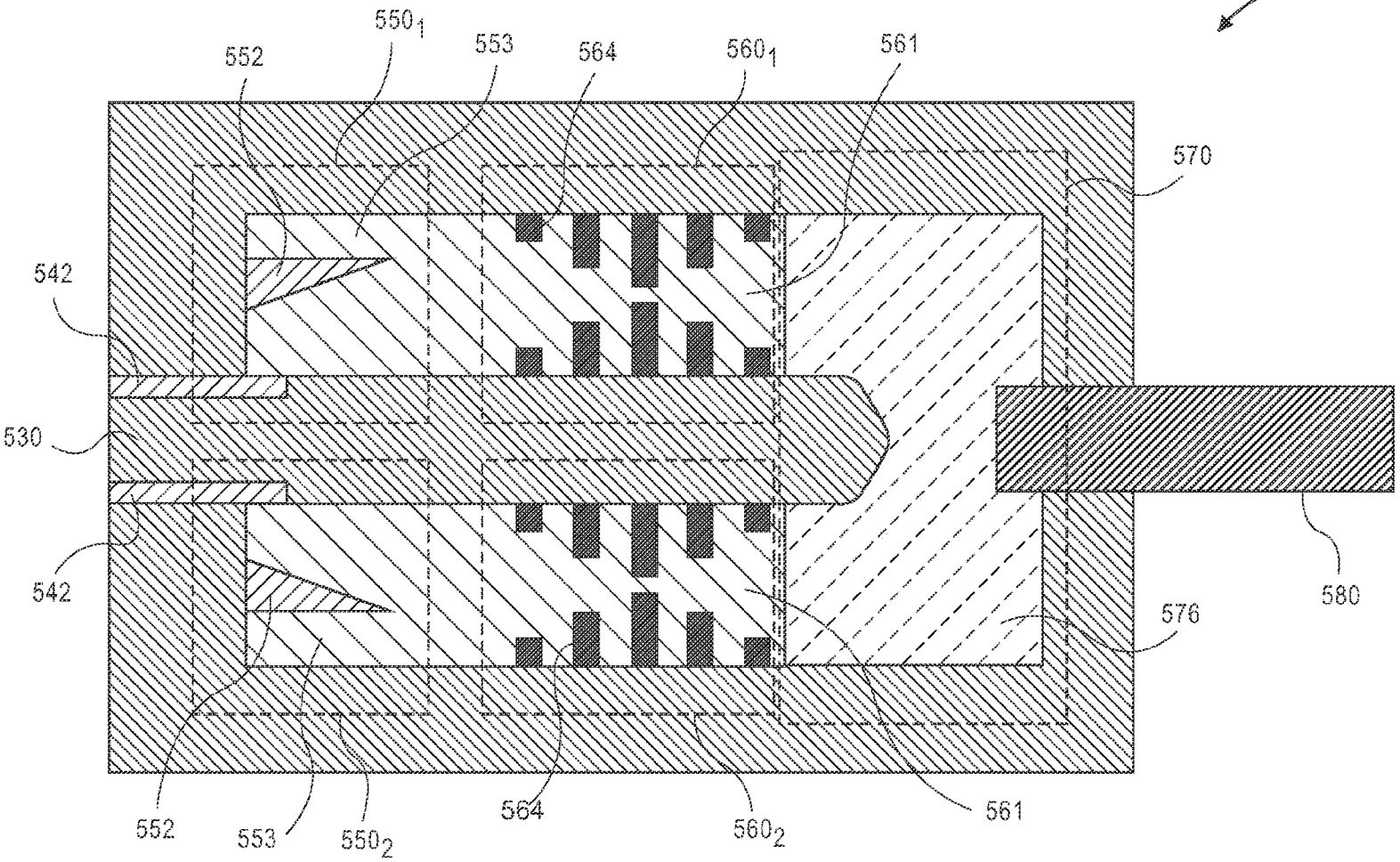
FIG. 5A is a plan view illustration of a mm-wave waveguide connector that includes a multiplexer and a ridge based waveguide filter, according to an embodiment of the invention.

Referring now to FIG. 5A, a plan view illustration of a mm-wave waveguide connector 520 is shown, according to an additional embodiment of the invention. In FIG. 5A, the mm-wave launchers 552 would appear as a fin (i.e., a thin rectangle) in a true plan view. However, FIG. 5A has been slightly modified to illustrate the mm-wave launchers 552 at a slight angle relative to the rest of the components in FIG. 5A for clarity. Instead of being formed as an edge connector (as shown in FIG. 2). FIG. 5A illustrates a mm-wave waveguide connector that is formed on a single surface of the packaging substrate 530. According to an embodiment, the mm-wave waveguide connector 520 may be substantially similar to the mm-wave waveguide connector 220 described above, with the exception that both waveguide launcher portions $\mathbf{550}_1$ and $\mathbf{550}_2$, both the filter portions $\mathbf{560}_1$ and $\mathbf{560}_2$, and the multiplexer portion 570 are formed on a single surface of the package substrate 530. Furthermore, while a two-band mm-wave waveguide connector 520 is shown, it is to be appreciated that additional embodiments may include a mm-wave waveguide connector 520 that is formed on a single surface of the package substrate 530 that accommodates three or more bands.

Figure 5B:
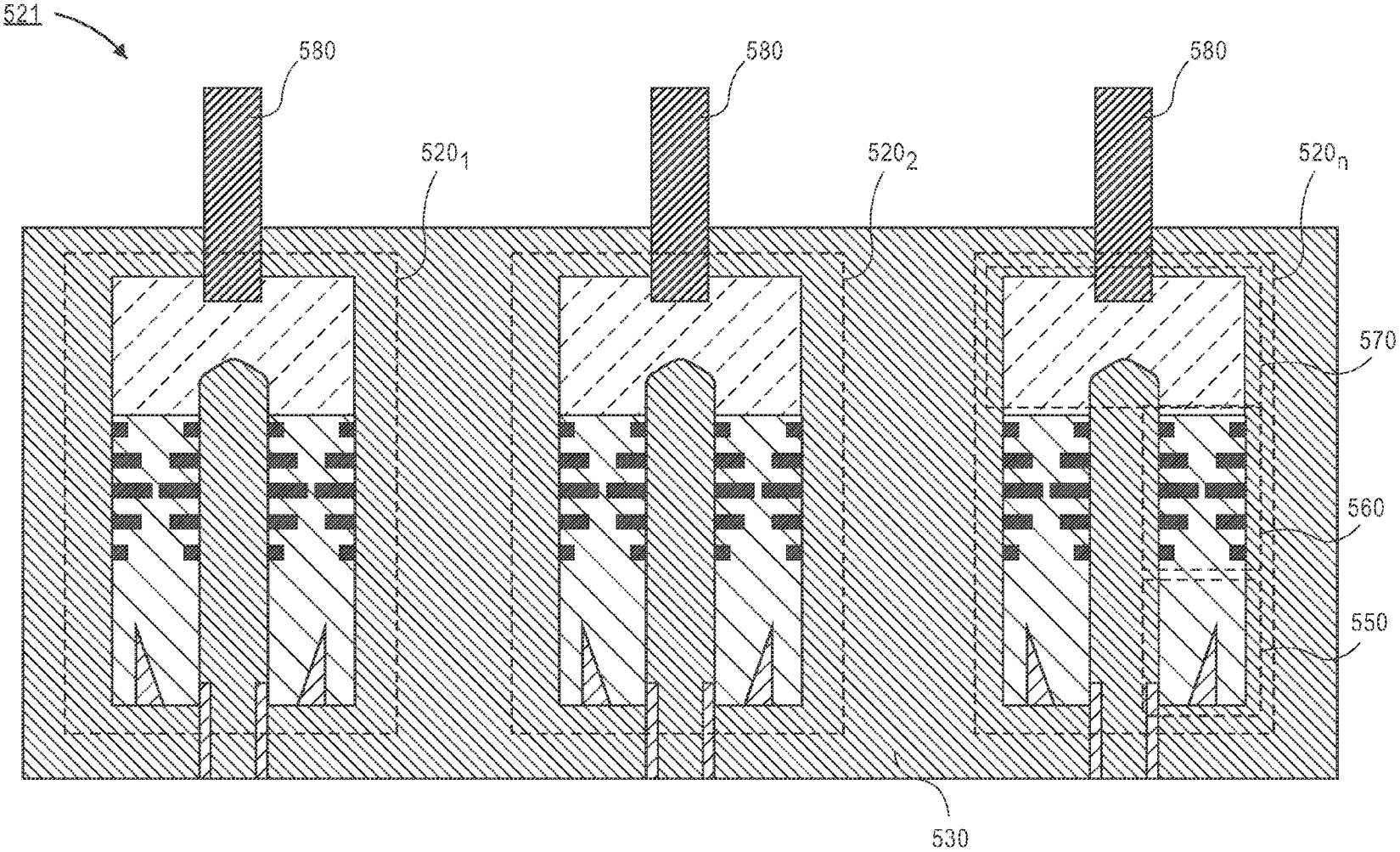
FIG. 5B is a plan view illustration of a plurality of mm-wave waveguide connectors that include a multiplexer and a ridge based waveguide filter formed on a single substrate, according to an embodiment of the invention.

Referring now to FIG. 5B, a plan view illustration of a computing system 521 with a plurality of mm-wave waveguide connectors 520 formed on a single package substrate 530 is shown, according to an embodiment of the invention. In the illustrated embodiment, each of the mm-wave waveguide connectors 520 are substantially similar to the mm-wave waveguide connectors 520 described in FIG. 5A, and therefore will not be described in greater detail here. Furthermore, while a plurality of mm-wave waveguide connectors 520 are shown on a single surface of the package substrate 530, it is to be appreciated that one or more mm-wave waveguide connectors 520 may also be formed on the opposing surface of the package substrate 530. Additional embodiments may also include forming a plurality of edge connector mm-wave waveguide connectors 220 similar to those described above on a single package 530.

Figure 5C:
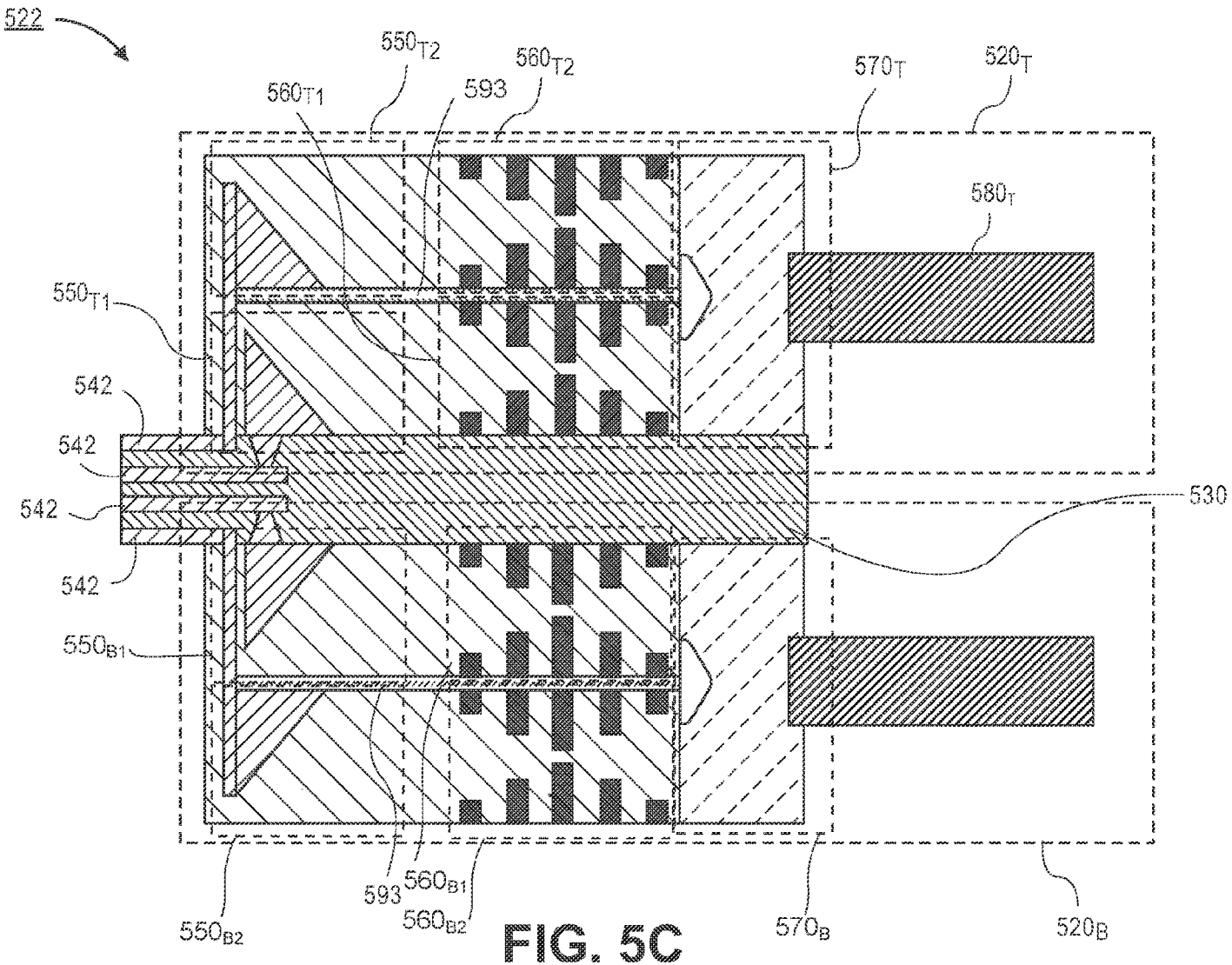
FIG. 5C is a cross-sectional illustration of two mm-wave waveguide connectors that include a multiplexer and a ridge based waveguide filter stacked on either side of the package substrate, according to an embodiment of the invention.

Referring now to FIG. 5C, a cross-sectional illustration of a computing system 522 with a plurality of mm-wave waveguide connectors 520 that are stacked in the Z-dimension is shown, according to an embodiment of the invention. In an embodiment, a first mm-wave waveguide connector $\mathbf{520}_T$ may be formed on a top surface of the package substrate 530 and a second mm-wave waveguide connector $\mathbf{520}_B$ may be formed on a bottom surface of the package substrate 530. For example, a first mm-wave launcher $\mathbf{550}_{T1}$, a first ridge based waveguide filter $\mathbf{560}_{T1}$, and a portion of the multiplexer 570 may be formed on the top surface of the substrate 530. Additionally, a second mm-wave launcher $\mathbf{550}_{T2}$ and a second ridge based waveguide filter $\mathbf{560}_{T2}$ may be formed over the first components. In an embodiment, the first components and the second components may be separated by a layer 593. For example, the layer may be an adhesive, a dielectric material, a conductive material, or the like. In an embodiment, the layer 593 may be omitted. In an embodiment, the mm-wave launchers may be coupled to separate conductive traces by different vias that pass through the package substrate 530 and/or through portions of the dielectric material in the in the mm-wave launchers $\mathbf{550}_{T1}$ and $550_{T2}$. In the illustrated embodiment, additional mm-wave waveguide connectors may be stacked over the top of the first mm-wave waveguide connector $520_T$. In an embodiment, the second mm-wave waveguide connector $520_B$ may also include substantially similar components to the first mm-wave waveguide connector $520_T$ except that they are formed on the opposite side of the package substrate 530. In an additional embodiment, the first mm-wave waveguide $520_T$ and the second mm-wave waveguide $520_B$ may be fabricated as a single component (similar to the embodiment illustrate in FIG. 2) and attached to the package substrate 530 as an edge connector. In such an embodiment, a single multiplexer may be used to combine/split four bands. In an embodiment, the stacking of the mm-wave waveguide components may be implemented by monolithic fabrication by assembling techniques, or by any other fabrication technique.

Additional embodiments of the invention may include a plurality of mm-wave waveguide connectors that are stacked in the Z-dimension in various configurations. In one embodiment, stacked mm-wave waveguide connectors may be stacked edge connectors (similar to the single edge connector illustrated in FIG. 2). For example, a first (inner) mm-wave waveguide connector may be substantially similar to the mm-wave waveguide connector illustrated in FIG. 2, and a second (outer) mm-wave waveguide connector may fit around the edges of the first (inner) mm-wave waveguide connector. Accordingly, the multiplexer portions of both the first (inner) mm-wave waveguide connector and the second (outer) mm-wave waveguide connector may couple to a ridge based waveguide filter above and below the package substrate. In an embodiment, the inner multiplexer portion may route the signal around the outer splitter (e.g., out of the plane of the cross-section illustrated in FIG. 2) in order to not need to pass through the outer multiplexer portion. Alternatively, the two mm-wave waveguide connectors may be staggered so that the outputs from the multiplexer portions are not in the same cross-sectional plane.

According to an embodiment of the invention, the mm-wave waveguide connector may be fabricated with any available fabrication techniques and is not limited to any specific method of fabrication. For example, in one embodiment metal three dimensional (3D) printing technologies may be used to form the conductive components (e.g., the protrusions in the filter portion, the waveguide launcher, conductive coatings around dielectric materials (or around air), etc.) of the mm-wave waveguide connector to form the final shape. Similarly, plastic 3D printing technologies may be used to form components that subsequently have metal coated over inner and/or outer surfaces of the components. In some embodiments, dielectrics may be formed with molding or hot embossing processes to form the shape of the different portions of the mm-wave waveguide connector. The dielectrics may subsequently have metal coated over their inner and/or outer surfaces. In yet another embodiment, semiconductor manufacturing processes may be used to form lithographically defined vias that can be formed into the desired shapes of the components. Additional embodiments may also include assembling discrete structures (e.g., fins, ridges, etc.) directly on the package substrate followed by overmolding of the package. In such embodiments, the package mold may subsequently be patterned (e.g., with stamping or etching) to form the walls of the various portions of the mm-wave waveguide connector. Selective metal coating of the patterned faces may then be used to form the outer shielded walls of the mm-wave waveguide connector.

Figure 6:
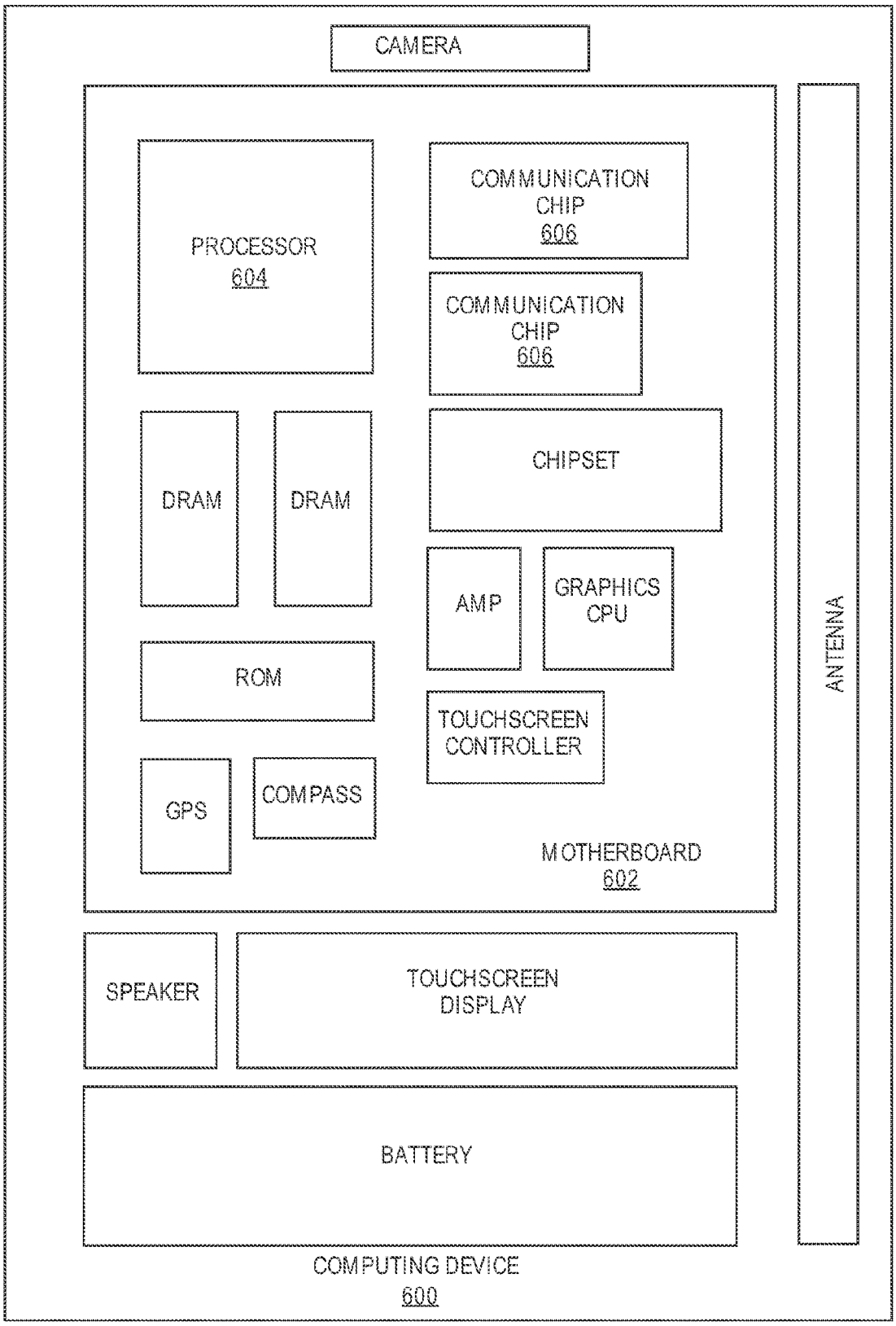
FIG. 6 is a schematic of a computing device built in accordance with an embodiment of the invention.

FIG. 6 illustrates a computing device 600 in accordance with one implementation of the invention. The computing device 600 houses a board 602. The board 602 may include a number of components, including but not limited to a processor 604 and at least one communication chip 606. The processor 604 is physically and electrically coupled to the board 602. In some implementations the at least one communication chip 606 is also physically and electrically coupled to the board 602. In further implementations, the communication chip 606 is part of the processor 604.

Depending on its applications, computing device 600 may include other components that may or may not be physically and electrically coupled to the board 602. These other components include, but are not limited to, volatile memory (e.g., DRAM), non-volatile memory (e.g., ROM), flash memory, a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, an accelerometer, a gyroscope, a speaker, a camera, and a mass storage device (such as hard disk drive, compact disk (CD), digital versatile disk (DVD), and so forth).

The communication chip 606 enables wireless communications for the transfer of data to and from the computing device 600. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 606 may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G. and beyond. The computing device 600 may include a plurality of communication chips 606. For instance, a first communication chip 606 may be dedicated to shorter range wireless communications such as Wi-Fi and Bluetooth and a second communication chip 606 may be dedicated to longer range wireless communications such as GPS, EDGE, GPRS, CDMA, WiMAX, LTE, Ev-DO, and others.

The processor 604 of the computing device 600 includes an integrated circuit die packaged within the processor 604. In some implementations of the invention, the integrated circuit die of the processor may be packaged on an organic substrate and provide signals that are propagated along a mm-wave waveguide connected to the substrate by a mm-wave waveguide connector that includes a multiplexer and a ridge based mm-wave filter, in accordance with implementations of the invention. The term "processor" may refer to any device or portion of a device that processes electronic data from registers and/or memory to transform that electronic data into other electronic data that may be stored in registers and/or memory.

The communication chip 606 also includes an integrated circuit die packaged within the communication chip 606. In accordance with another implementation of the invention, the integrated circuit die of the communication chip may be packaged on an organic substrate and provide signals that are propagated along a mm-wave waveguide connected to the substrate by a mm-wave waveguide connector that includes a multiplexer and a ridge based mm-wave filter, in accordance with implementations of the invention.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize.

These modifications may be made to the invention in light of the above detailed description. The terms used in the following claims should not be construed to limit the invention to the specific implementations disclosed in the specification and the claims. Rather, the scope of the invention is to be determined entirely by the following claims, which are to be construed in accordance with established doctrines of claim interpretation.

Example 1: a mm-wave waveguide connector, comprising: a first mm-wave launcher portion; a first ridge based mm-wave filter portion communicatively coupled to the first mm-wave launcher portion, wherein the ridge based mm-wave filter portion includes a plurality of protrusions that define one or more resonant cavities; and a multiplexer portion communicatively coupled to the first ridge based mm-wave filter portion.

Example 2: the mm-wave waveguide connector of Example 1, wherein the multiplexer portion is communicatively coupled to one or more additional ridge based mm-wave filter portions and one or more additional mm-wave launcher portions.

Example 3: the mm-wave waveguide connector of Example 1 or Example 2, wherein the first mm-wave launcher portion and the first ridge based mm-wave filter portion are formed on a first surface of a package substrate and at least one of the one or more additional ridge based mm-wave filter portions and at least one of the one or more additional mm-wave launcher portions are formed on a second surface of the package.

Example 4: the mm-wave waveguide connector of Example 1, Example 2, or Example 3, wherein the first mm-wave launcher portion and the first ridge based mm-wave filter portion are formed on a first surface of a package substrate and at least one of the one or more additional ridge based mm-wave filter portions and at least one of the one or more additional mm-wave launcher portions are formed on the first surface of the package.

Example 5: the mm-wave waveguide connector of Example 1, Example 2, Example 3, or Example 4, wherein the first ridge based mm-wave filter portion includes a third order bandpass filter or greater.

Example 6: the mm-wave waveguide connector of Example 5, wherein the first ridge based mm-wave filter portion provides a signal roll-off of 20 dBs in 3 GHz or less.

Example 7: the mm-wave waveguide connector of Example 5 or Example 6, wherein the first ridge based mm-wave filter portion provides a signal roll-off of 20 dBs in 1 GHz or less.

Example 8: the mm-wave waveguide connector of Example 1, Example 2, Example 3. Example 4, Example 5, Example 6, or Example 7, wherein the plurality of protrusions define resonant cavities with openings between 0.5 mm and 2.0 mm.

Example 9: the mm-wave connector of Example 1, Example 2, Example 3, Example 4, Example 5, Example 6, Example 7, or Example 8, wherein the plurality of protrusions are spaced apart from each other by a spacing between 0.5 mm and 2.0 mm.

Example 10: the mm-wave waveguide connector of Example 1, Example 2, Example 3, Example 4, Example 5, Example 6, Example 7, Example 8, or Example 9, wherein the plurality of protrusions have a thickness between 200 μm and 1,000 μm.

Example 11: the mm-wave waveguide connector of Example 1, Example 2, Example 3, Example 4, Example 5, Example 6, Example 7, Example 8, Example 9, or Example 10, wherein one or more of the mm-wave launcher portion, the ridge based filter portion, and the multiplexer portion are coupled to each other with a fitting.

Example 12: the mm-wave waveguide connector of Example 1, Example 2, Example 3, Example 4, Example 5, Example 6, Example 7, Example 8, Example 9, Example 10, or Example 11, wherein the mm-wave launcher portion, the ridge based filter portion, and the multiplexer portion are integrated together as a single component.

Example 13: the mm-wave waveguide connector of Example 12, wherein the mm-wave waveguide connector is an edge connector that connects to an edge of a package substrate.

Example 14: the mm-wave waveguide connector of Example 13, wherein the package substrate includes mechanical stops and/or alignment features.

Example 15: a ridge based bandpass filter, comprising: a conductive enclosure; a plurality of resonator cavities formed within the conductive enclosure that are communicatively coupled to each other by openings, wherein a plurality of protrusions extending from the conductive enclosure define the plurality of resonator cavities.

Example 16: the ridge based bandpass filter of Example 15, further comprising: a dielectric material filling the conductive enclosure.

Example 17: the ridge based bandpass filter of Example 15 or Example 16, wherein the openings between each resonator cavity are not all uniform.

Example 18: the ridge based bandpass filter of Example 15, Example 16, or Example 17, wherein the plurality of protrusions do not have a substantially uniform spacing.

Example 19: the ridge based bandpass filter of Example 15, Example 16, Example 17, or Example 18, wherein the plurality of resonant cavities includes three or more resonant cavities.

Example 20: the ridge based bandpass filter of Example 15, Example 16, Example 17, Example 18, or Example 19, wherein the ridge based bandpass filter provides a signal roll-off of 20 dBs in 3 GHz or less.

Example 21: the ridge based bandpass filter of Example 15, Example 16, Example 17, Example 18, Example 19, or Example 20, wherein the plurality of protrusions define resonant cavities with openings between 0.5 mm and 2.0 mm, wherein the plurality of protrusions are spaced apart from each other by a spacing between 0.5 mm and 2.0 mm, and wherein the plurality of protrusions have a thickness between 200 μm and 1,000 μm.

Example 22: the ridge based bandpass filter of 15, Example 16, Example 17, Example 18, Example 19, Example 20, or Example 21, wherein the openings are apertures.

Example 23: a computing system comprising: a package substrate; a plurality of mm-wave waveguide connectors coupled to the package substrate, wherein each of the mm-wave waveguide connectors comprises: a plurality of mm-wave launcher portions; a plurality of ridge based mm-wave filter portions each communicatively coupled to one of the first mm-wave launcher portion, wherein the ridge based mm-wave filter portions each include a plurality of protrusions that define one or more resonant cavities: and a multiplexer portion communicatively coupled to the plurality of ridge based mm-wave filter portions and communicative coupled to a mm-wave waveguide bundle.

Example 24: the computing system of Example 23, wherein the package substrate is a package substrate in a server or a high performance computing (HPC) system.

Example 25: the computing system of Example 23 or Example 24, wherein each of the plurality of ridge based mm-wave filter portions includes a bandpass filter that filters different portions of an available bandwidth of the mm-wave waveguide bundle.

What is claimed is:

1. A mm-wave waveguide connector, comprising:

a first mm-wave launcher portion;

a first ridge based mm-wave filter portion communicatively coupled to the first mm-wave launcher portion, wherein the ridge based mm-wave filter portion includes a plurality of protrusions that define one or more resonant cavities, wherein a first one of the plurality of protrusions has a first height, and a second one of the plurality of protrusions has a second height different than the first height; and a multiplexer portion communicatively coupled to the first ridge based mm-wave filter portion.

2. The mm-wave waveguide connector of claim 1, wherein the multiplexer portion is communicatively coupled to one or more additional ridge based mm-wave filter portions and one or more additional mm-wave launcher portions.

3. The mm-wave waveguide connector of claim 2, wherein the first mm-wave launcher portion and the first ridge based mm-wave filter portion are formed on a first surface of a package substrate and at least one of the one or more additional ridge based mm-wave filter portions and at least one of the one or more additional mm-wave launcher portions are formed on a second surface of the package substrate.

4. The mm-wave waveguide connector of claim 2, wherein the first mm-wave launcher portion and the first ridge based mm-wave filter portion are formed on a first surface of a package substrate and at least one of the one or more additional ridge based mm-wave filter portions and at least one of the one or more additional mm-wave launcher portions are formed on the first surface of the package substrate.

5. The mm-wave waveguide connector of claim 1 wherein the first ridge based mm-wave filter portion includes a third order bandpass filter or greater.

6. The mm-wave waveguide connector of claim 5, wherein the first ridge based mm-wave filter portion provides a signal roll-off of 20 dBs in 3 GHz or less.

7. The mm-wave waveguide connector of claim 5, wherein the first ridge based mm-wave filter portion provides a signal roll-off of 20 dBs in 1 GHz or less.

8. The mm-wave waveguide connector of claim 1, wherein the plurality of protrusions define resonant cavities with openings between 0.5 mm and 2.0 mm.

9. The mm-wave waveguide connector of claim 1, wherein the plurality of protrusions have a thickness between 200 μm and 1,000 μm.

10. The mm-wave waveguide connector of claim 1, wherein one or more of the mm-wave launcher portion, the ridge based filter portion, and the multiplexer portion are coupled to each other with a fitting.

11. The mm-wave waveguide connector of claim 1, wherein the mm-wave launcher portion, the ridge based filter portion, and the multiplexer portion are integrated together as a single component.

12. The mm-wave waveguide connector of claim 11, wherein the mm-wave waveguide connector is an edge connector that connects to an edge of a package substrate.

13. The mm-wave waveguide connector of claim 12, wherein the package substrate includes mechanical stops and/or alignment features.

14. A ridge based bandpass filter, comprising:

a conductive enclosure; and a plurality of resonator cavities formed within the conductive enclosure that are communicatively coupled to each other by openings, wherein a plurality of protrusions extending from the conductive enclosure define the plurality of resonator cavities, wherein a first one of the plurality of protrusions has a first height, a second one of the plurality of protrusions has a second height different than the first height, and a third one of the plurality of protrusions has a third height the same as the first height or the second height.

15. The ridge based bandpass filter of claim 14, further comprising:

a dielectric material filling the conductive enclosure.

16. The ridge based bandpass filter of claim 14, wherein the openings between each resonator cavity are not all uniform.

17. The ridge based bandpass filter of claim 14, wherein the plurality of protrusions do not have a substantially uniform spacing.

18. The ridge based bandpass filter of claim 14, wherein the plurality of resonant cavities includes three or more resonant cavities.

19. The ridge based bandpass filter of claim 18, wherein the ridge based bandpass filter provides a signal roll-off of 20 dBs in 3 GHz or less.

20. The ridge based bandpass filter of claim 19, wherein the plurality of protrusions define resonant cavities with openings between 0.5 mm and 2.0 mm, and wherein the plurality of protrusions have a thickness between 200 μm and 1,000 μm.

21. A ridge based bandpass filter, comprising:

a conductive enclosure; and a plurality of resonator cavities formed within the conductive enclosure that are communicatively coupled to each other by openings, wherein a plurality of protrusions extending from the conductive enclosure define the plurality of resonator cavities, wherein a first one of the plurality of protrusions has a first height, and a second one of the plurality of protrusions has a second height different than the first height, wherein the plurality of resonant cavities includes three or more resonant cavities, and, wherein the ridge based bandpass filter provides a signal roll-off of 20 dBs in 3 GHz or less.

* * * * *